US005130611A

United States Patent [19]

Johns

[11] Patent Number: 5,130,611

[45] Date of Patent: Jul. 14, 1992

[54] UNIVERSAL ELECTRONIC BALLAST SYSTEM

[75] Inventor: Douglas A. Johns, West Palm Beach, Fla.

[73] Assignee: Intent Patents A.G., Vaduz, Liechtenstein

[21] Appl. No.: 639,338

[22] Filed: Jan. 16, 1991

[51] Int. Cl.[5] ..... H05B 41/36

[52] U.S. Cl. ..... 315/224; 315/307; 315/279; 315/225; 315/219; 315/287; 315/DIG. 7

[58] Field of Search ..... 315/DIG. 7, 307, 224, 315/277, 279, 225, 226, 219, 287

[56] References Cited

U.S. PATENT DOCUMENTS

| | | | |
|---|---|---|---|
| 4,075,476 | 2/1978 | Pitel | 315/209 R |
| 4,127,795 | 11/1978 | Knoll | 315/210 |
| 4,259,616 | 3/1981 | Smith | 315/256 |
| 4,277,726 | 7/1981 | Burke | 315/98 |
| 4,344,122 | 8/1982 | Jones | 363/23 |
| 4,353,009 | 10/1982 | Knoll | 315/220 |
| 4,414,491 | 11/1983 | Elliott | 315/282 |
| 4,414,492 | 11/1983 | Hanlet | 315/290 |
| 4,481,460 | 11/1984 | Kröning et al. | 323/266 |
| 4,503,361 | 3/1985 | Hanlet | 315/221 |
| 4,503,362 | 3/1985 | Hanlet | 315/221 |
| 4,547,706 | 10/1985 | Krummel | 315/226 |
| 4,562,383 | 12/1985 | Kerscher et al. | 315/225 |
| 4,587,461 | 5/1986 | Hanlet | 315/224 |
| 4,609,850 | 9/1986 | Hanlet | 315/219 |
| 4,613,934 | 9/1986 | Pacholok | 315/DIG. 7 X |
| 4,616,158 | 10/1986 | Krummel et al. | 315/225 |
| 4,710,682 | 12/1987 | Zuchtriegel | 315/224 |
| 4,716,343 | 12/1987 | Lindquist | 315/307 |
| 4,733,135 | 3/1988 | Hanlet | 315/224 |
| 4,808,887 | 2/1989 | Fähnrich et al. | 315/247 |
| 4,902,938 | 2/1990 | Lindquist | 315/307 |
| 4,970,439 | 11/1990 | Stopa | 315/224 X |
| 5,055,747 | 10/1991 | Johns | 315/224 X |

OTHER PUBLICATIONS

TDA 4814A Specification data sheet, Siemens Components, Inc. 1988.

*Primary Examiner*—Eugene R. Laroche
*Assistant Examiner*—Do Hyun Yoo
*Attorney, Agent, or Firm*—Morton J. Rosenberg; David I. Klein

[57] ABSTRACT

A universal electronic ballast system (10) is provided for actuating at least one gas discharge lamp (1900) having any one of a plurality of predetermined wattage ratings. Electronic ballast system (10) includes a filter circuit coupled to an AC power mains (100, 110) for substantially suppressing spurious signals passing into or from the power source. The filter circuit is coupled to a regulated switching power supply circuit (14) which generates a regulated boost voltage and draws a substantially constant in phase sinusoidal load current from the power source supplied to a switching circuit (16) which generates a regulated pulsating current at a predetermined frequency. Responsive to the regulated pulsating current a high voltage is induced in the primary windings (1710 and 1680) of induction transformer (T3). The high voltage is coupled to gas discharge lamp (1900) by means of the magnetic coupling betwen primary winding (1730) and secondary winding (1765) of the output transformer (T2). Universal electronic ballast system (10) monitors the presence of gas discharge lamp (1900) by means of the voltage divider (1270, 1830) and protection circuit formed by diode (1490), and transistors (1380 and 1440), for maintaining the switching transistor (1590) in an "off" condition by shunting the base drive signal therefrom responsive to gas discharge lamp (1900) being removed from ballast system (10).

20 Claims, 4 Drawing Sheets

UNIVERSAL ELECTRONIC BALLAST SYSTEM

BACKGROUND OF THE INVENTION

1. Fiedl of the Invention

This invention is directed to an electronic ballast system for fluorescent or gas discharge lamps. In particular, this invention relates to a universal electronic ballast system for fluorescent lamps. Still further, this invention relates to an electronic ballast system which operates over a wide voltage input range at either 50 or 60 cycles, and may be utilized for driving fluorescent lamps having any one of a plurality of wattage ratings, tube diameters and lengths. Further, this invention is directed to an electronic ballast system utilizing a switching power supply which draws a substantially constant sinusoidal current from the AC power source. More in particular, this invention pertains to the induction circuit being coupled in feedback relationship to the switching circuit for terminating the switching circuit operation responsive to the gas discharge lamp being electrically uncoupled from the output transformer.

Still further, this invention directs itself to a switching circuit wherein both the load current and switching transistor collector current are monitored to provide positive feedback to the base drive circuit. Additionally, this invention pertains to a switching circuit wherein the emitter current of the switching transistor is monitored for rapidly turning off the switching transistor responsive to the emitter current reaching a predetermined value. The emitter current monitoring circuit providing a means by which the switching circuit compensates for transistor characteristics which vary from one switching transistor to another. Further, the switching circuit is feedback coupled to the regulated power supply circuit for terminating the generation of the boost voltage provided thereby, responsive to electrical uncoupling of the gas discharge lamp from the ballast system.

2. Prior Art

Electronic ballast systems for gas discharge or fluorescent lamps are well known in the art. However, in some prior art electronic ballast systmes, removal of the gas discharge of fluorescent lamp from the ballast circuit causes exceswsive voltage outputs to the lamp connection contacts. This condition can have a deleterious effect on the operating life of the ballast system components.

Other prior art systems compensate for the no-load condition by incorporating complex inductigve circuits whose impedance varies inversely proportional to the load current, or alternately shift the operting frequency of the ballast system to force a lower voltage to be generated. However, such systems are difficult to manufacture, requiring tight controls on component characteristics. Problems occur where some of the critical components cannot be maintained within the tight tolerances required and thus some percentage of such ballast systems do no function sufficiently well to provide the necessary no-load protection.

Other prior art electronic ballast systems may be designed to operate over a range of input voltages, without the requirement for changing transformer taps, or component values, such systems are designed to drive a particular wattage lamp. Whereas in the instant invention not only will the ballast operate on a wide range of AC voltages, but lamps of any one of a wide range of wattages, tube diameters and lengths may be efficiently operated with the instant invention. This improvement provides great advantages to manufacturers of lighting systems wherein a single ballast system is usable within a broad range of lighting fixtures, as opposed to prior art systems which required a particular ballast to be matched with a lamp of particular wattage and physical characteristics.

SUMMARY OF THE INVENTION

A universal electronic ballast system coupled to a power source for actuating at least one gas discharge lamp, having any one of a plurality of predetermined wattage ratings, where the gas discharge lamp includes a pair of heater filaments is provided. The electronic ballast system includes a filter circuit coupled to the power source for substantially suppressing spurous signals from passing into or from the power source. Further, the ballast system includes a regulated power supply circuit coupled to the filter circuit for (1) maintaining a substantially constant sinusoidal load current in phase with the voltage from the power source, and (2) providing a regulated DC voltage output. A switching circuit is coupled to the regulated output of the regulated power supply circuit for generating a regulated pulsating current at a predetermined frequency. Further, an induction circuit is coupled to the switching circuit for actuating the gas discharge lamp. The induction circuit includes an output transformer coupled to the gas discharge lamp. The induction circuit is coupled in feedback relationship to the switching cicuit for terminating the pulsating current responsive to the gas discharge lamp being electrically uncoupled from the output transformer.

DESCRIPTION OF THE PREFERRED EMBODIMENTS

Referring to the Figures, there is shown universal electronic ballast system 10 for coupling to a power source, whereby at least one gas discharge lamp 1900 is actuated. Gas discharge lamp 1900 may be any one of a plurality of standard fluorescent type systems having first and second filaments 1870 and 1880, respectively. Fluorescent lamp 1900 may be any one of a plurality of different styles and wattage ratings, having a length within the approximating range of 2–5 feet, having diameters within the range of ⅝ inch to 1½ inches, and wattage ratings within the approximating range of 20–50 watts. Although each of these differently configured fluorescent lamps 1900 have differing operating characteristics, universal electronic ballast system 10 is capable of automatically compensating for these differing operating characteristics and providing efficient operation thereof.

In overal concept, universal electronic ballast system is provided for maximization of the efficiency of light output from the gas discharge lamp 1900 with respect to the power input to electronic ballast system 10 over a wide range of voltages. Additionally, universal electronic ballast system 10 draws a substantially sinusoidal load current in phase with the voltage from the power source, while maintaining a substantially unity phase relationship between the source voltage and load current drawn from the AC power mains.

Additionally, universal electronic ballast system 10 incorporates a regulated switching circuit 16 wherein an electronic switch 1590 is operated to provide a regulated pulsating current. The current passing through the electronic switching device is monitored to maintain a substantially constant gain value for the switching circuit. Further, the load current is monitored to provide a feedback signal to the electronic switch to provide a drive signal proportional thereto. Further, universal electronic ballast system 10 includes protection circuitry in both the switching circuit and its regulated power supply for terminating operation of ballast system 10 responsive to particular parameters exceeding predetermined values.

Of particular importance, universal electronic ballast system 10 is capable of operation over a wide range of AC voltages from sources having frequencies of either 50 or 60 Hertz without the necessity of changing transformer taps, components or component values. Similarly, universal electronic ballast system 10 is capable of automatically compensating for the differing electrical characteristics of gas discharge lamps of varying sizes and wattages.

Figure 2:
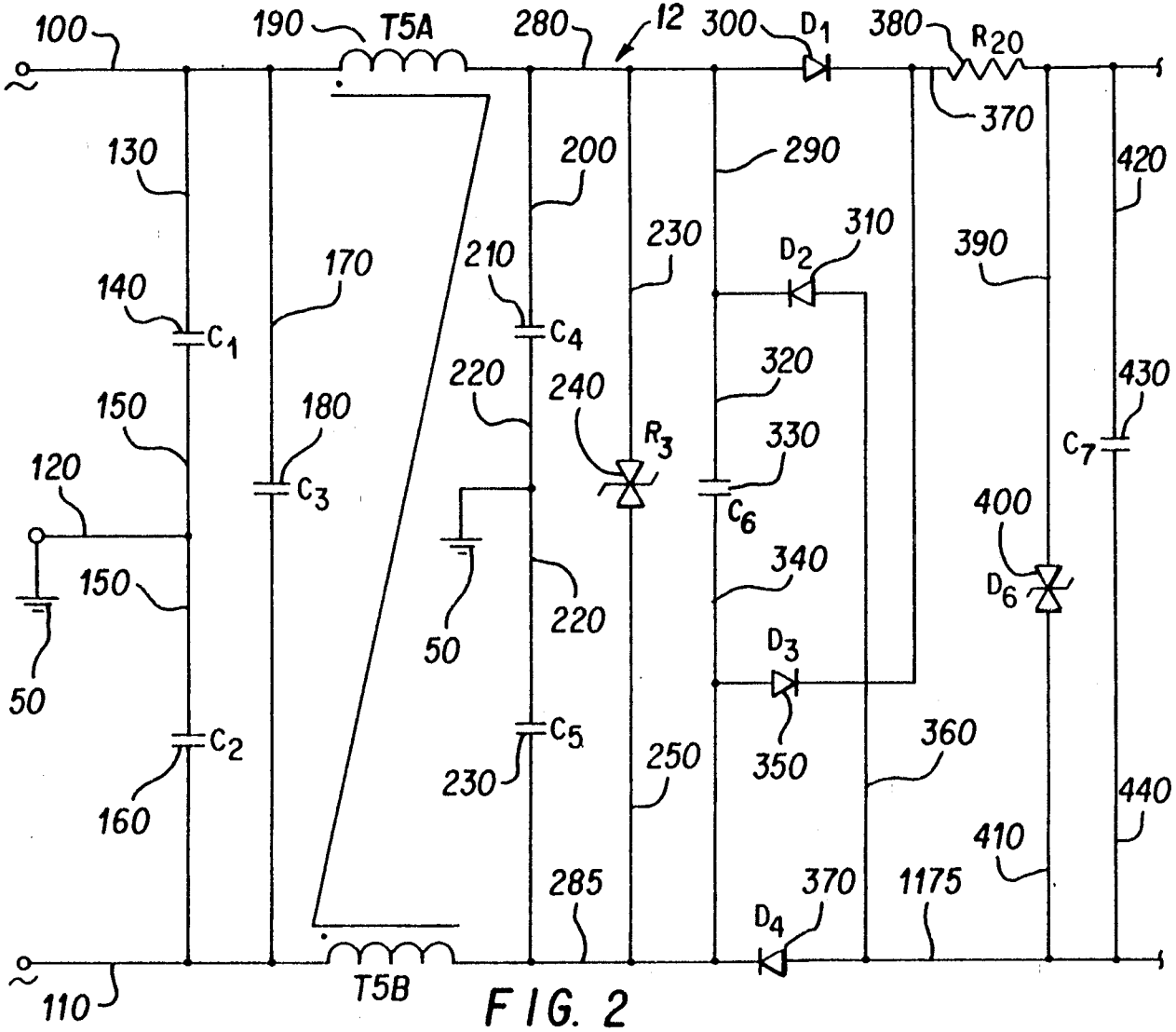
FIG. 2 is a schematic diagram of the filter and rectification portion of the electronic ballast system.
Figure 1:
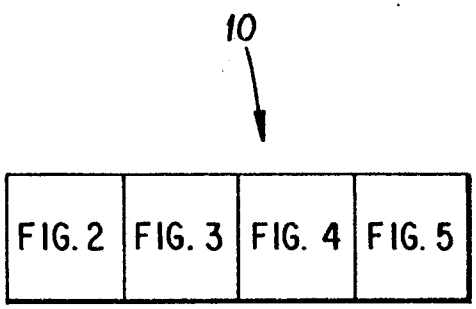
FIG. 1 is a block diagram showing the interfacing of the electronic circuits of FIGS. 2–5.

Referring now to FIG. 2, universal electronic ballast system 10 provides a pair of leads 100 and 110 for coupling to an AC power source, and a lead 120 for coupling to a ground connection. Leads 100, 110 and 120 provide connection to a filter circuit 12 of ballast system 10. The filter circuit is intended to prevent high frequency signals generated within ballast system 10 from feeding back through the AC power lines, and also to prevent high frequency transients from interfering with the ballast system circuits. The input to filter circuit 12 is provided with a standard capacitance filtering arrangement wherein a capacitor 140 is coupled between line 100 and line 120 by means of the connection lines 130 and 150, respectively. Likewise, capacitor 160 is coupled between the opposing power line lead 110 and ground 120, and capacitor 180 is coupled in parallel relation to both capacitors 140 and 160, capacitor 180 being coupled on opposing ends to respective lines 100 and 110. Capacitors 140 and 160 are 470 pf, 250 V. capacitors and capacitor 180 is a 0.1 μf, 250 V. capacitor. Lines 100 and 110 extend from the shunt filter capacitor 180 to a common mode chocke 190, providing a series inductance to each of lines 100 and 110. Common mode chocke 190 is a commercially available component, and my have a manufacturer's designation B82723-A2102-N1, available from Siemens Components, Inc, of Mt. Laurel, N. J.

The output from common mode chocke 190 is coupled to a capacitance filter arrangement similar to that provided on the input of chocke 190. Capacitor 210, being a 1000 pf, 250 V. capacitor, is coupled between the chocke output line 280 and ground connection 50, while capacitor 230, being identical to capacitor 210, is coupled between the opposing chocke output line 285 and ground connection 50. Capacitor 330, being a 0.33 μf, 250 V. capacitor, is coupled in parallel relationship with the series combination of capacitors 210 and 230 to further filter spurious signals transmitted from the power line and also to filter any spurious signals generated by the ballast system circuits.

In order to protect against high voltage surges which may be transmitted by the AC power lines, such as may be caused by lightning strikes or switching of large loads, metal oxide varistor 240 is coupled in parallel relation with capacitor 330 across the common mode choke output lines 280 and 285. Varistor 240 may be any of a number of commercially available components, one such varistor may have a designation TNR9G471KM, available from Marcon America Corp. of Vernon Hills, Ill.

The common mode choke output lines 280 and 285 are coupled to a full wave rectification bridge circuit formed by the diodes 300, 310, 350 and 370 for providing rectification of the AC voltage supplied thereto. Diodes 300, 310, 350 and 370 may be one of a number of standard diode elements, and in one form of universal electronic ballast system 10, diode elements 300, 310, 350 and 370 have a standardized designation of 1N4006.

The rectified voltage supplied from diodes 300, 310, 350 and 370 provides an unregulated pulsating DC voltage signal across lines 370 and 1175. In series relation with the DC output line 370 there is provided a current limiting resistor 380, having a resistance of 5.0 ohms, for limiting the inrush current when electronic ballast system 10 is first energized. Resistor 380 is coupled in series relation with the rectifier output line 370 and the regulated power supply circuit input line 450.

Filter capacitor 430 is coupled between regulated power supply input line 450 and the rectifier return line 1175 for providing a standard smoothing function for the pulsating DC voltage. Capacitor 430 is a 0.1 μf, 450 V. capacitor. In parallel relation with capacitor 430 there is provided a transient protection diode 400 for suppressing transient voltages. Transient protection diode 400 provides added protection from voltage surges, and while it is intended to suppress transience of lower magnitude than metal oxide varistor 240, its switching speed is considerably faster, thereby providing protection from steep wavefront surges. Transient protection diode may be a commercially available component having a designation BZWO4-376, available from General Instruments of Hicksville, N. Y.

Figure 3:
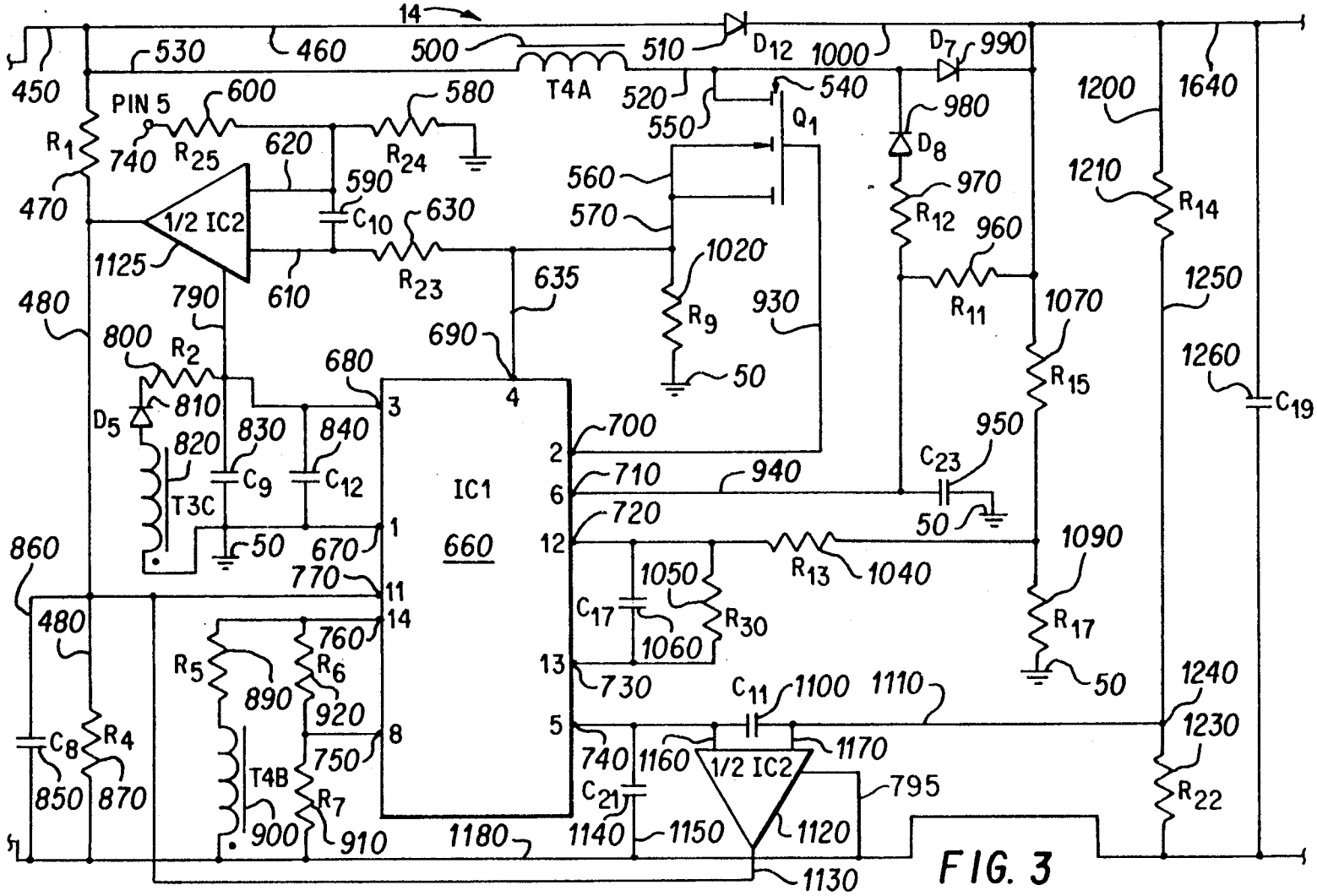
FIG. 3 is a schematic deiagram of the regulated power supply portion of the electronic ballast system.

Referring now to FIG. 3 there is shown the regulated power supply circuit 14 of universal electronic ballast system 10. As will be explained in following paragraphs, the regulated power supply circuit depends on operation of the switching circuit 16, FIG. 4, for its operation. But, initially the unregulated DC voltage from regulated power suppy input line 450 is supplied to the switching circuit 16. Diode 510 being coupled in series relation with regulated power supply input line 450 and regulated power supply output line 1640 provides the path for the unregulated voltage during the initial start-up of ballast system 10. Diode 510 is a commercially available 1N4006 diode.

Figure 4:
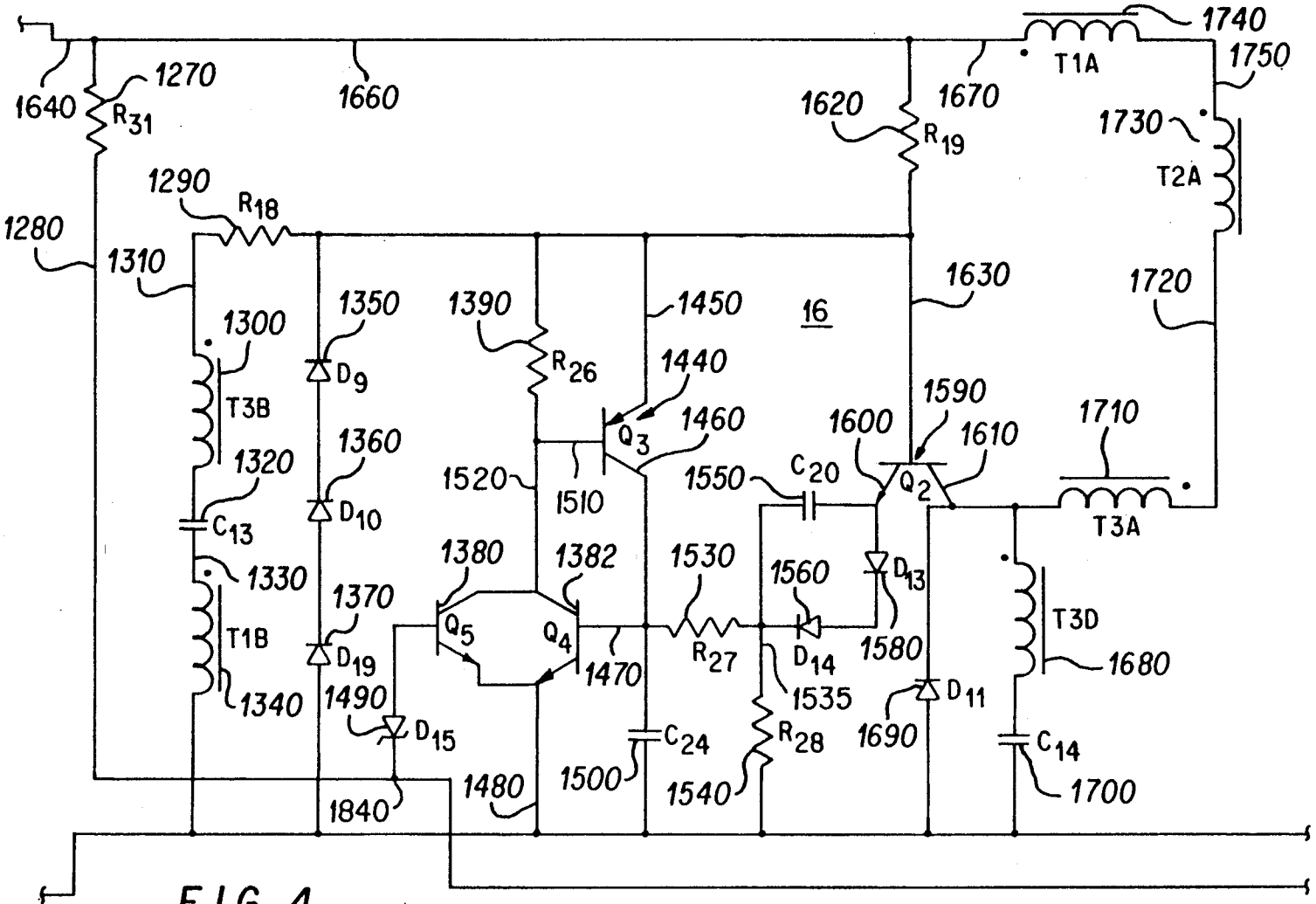
FIG. 4 is a schematic diagram of the switching circuit portion of the electronic ballast system; and, FIG. 5 is a schematic diagram of the output portion of the electronic ballast system.

Referring now to FIG. 4, there is shown the switching circuit 16 of electronic ballast system 10. During initial start-up, the unregulated voltage supplied on line 1640 is conducted to line 1660, transformer winding 1740, output transformer primary winding 1730 and transformer winding 1710 to the collector 1610 of switching transistor 1590. Initially, transistor 1590 is in an "off" condition, but resistor 1620, being a 360 Kohm resistor, and having one end coupled to line 1660 and the opposing end coupled to the base 1630 of transistor 1590 provides a conductive path to initially turn transistor 1590 "on". As transistor 1590 is turned "on", current begins to flow through windings 1740, 1730, and 1710. The current flowing through transistor 1590, from collector 1610 to emitter 1600, through the series coupled diodes 1580 and 1560, through resistor 1540, having a value approximating 0.64 ohms, and back to the return line 1175. The flow of current through the windings 1740, 1730 and 1710 induces respective voltages therein. One such transistor 1590 which has been successfully utilized has the designation MJE8502, available from Motorola, Inc. of Tempe, Az. Diodes 1580 and 1560 may have a commercial designation of 1N4001.

The base drive circuit for transistor 1590 comprises a secondary winding 1340 of transformer T1 having a first end coupled to the return line 1175 and the opposing end coupled to a capacitor 1320, being a 0.22 μf, 100 V. capacitor. The opposing end of capacitor 1320 is coupled in series relation with secondary winding 1300 of transformer T3. The opposing end of winding 1300 is coupled in series relationship with resistor 1290, having a value of 300 ohms, which is in turn coupled to the base 1630 of transistor 1590. By virtue of the magnetic coupling between primary winding 1710 of transformer T3 and secondary winding 1300 a voltage is induced in winding 1300 responsive to the voltage induced by the change of current through primary winding 1710. Similarly, secondary winding 1340 of transformer T1 is magnetically coupled to the primary winding 1740 for inducing a voltage across secondary winding 1340 responsive to the induced voltage of primary winding 1740, as is well known in the transformer art. Transformer T1 is formed on a toroidal core having a designation F41206, available from Magnetics, Inc. of East Butler, Pa. Winding 1740 is formed of 1 turn, and winding 1340 is formed by 10 turns.

As indicated by the dot convention, shown in FIG. 4, the voltages induced in windings 1300 and 1340 is of a polarity which enhances the turn-on of transistor 1590. Thus, as current begings to flow in the collector circuit a positive feedback voltage is generated within the windings 1300 and 1340, to drive transistor 1590 to a full "on" condition. The voltages induced in the windings are additive, and the rate of change of the base current is a function of the LC time constant of the base drive circuit.

The LC time constant being a function of the inductance of windings 1340 and 1300 in combination with the capacitance of capacitor 1320. Resistor 1290 coupled in series between the winding 1300 and base 1630 of transistor 1590 functions as a current limiting resistor for providing a nominal base current of a predetermined value, to provide sufficient base current for the particular type of transistor 1590 utilized in the circuit.

Transformer T3 is formed using a commercially available core having a designation P43524, available from Magnetics, Inc., with a tapped primary winding defined by winding portions 1710 and 1680, having 268 and 134 turns, respectively. The tap between windings 1710 and 1680 is coupled to collector 1610 of transistor 1590. The connection of the primary winding of transformer T3 in this fashion provides an autotransformer configuration for the subsequent generation of the high voltage necessary to actuate the gas discharge lamp 1900.

Subsequent to transistor 1590 being driven to an "on" condition, the collector current flowing through windings 1740, 1730 and 1710 approaches a steady state value, the change in current being substantially linear. As current flows through winding 1710, a voltage is induced in winding 1680, however, the voltage induced increases exponentially by virtue of the series coupled capacitor 1700 coupled between one end of winding 1680 and the return line 1175. Capacitor 1700 is a 3.3 nf, 1600 V. capacitor. The collector current reaches its steady state value in a time period controlled by the LC time constant of the collector circuit, which becomes controlling after the initial start up. This time constant is a function of the inductance of windings 1710, 1680 and the apparent inductance of winding 1730 and the capacitance of capacitor 1700. The inductance of winding 1730 is a function of both the inductance of the winding 1730 itself, and the reflected impedance from the secondary circuit, whose most significant impedance is the capacitance of capacitor 1940, shown in FIG. 5.

As is well known from classical theory, transformer action only takes place when there is a change in current flow. Thus, as the steady state collector current is reached the voltage polarities of the transformer primary windings 1740, 1730, and 1680 reverse, as does the secondary windings 1300 and 1340. The reversal of the windings 1300 and 1340 in the base drive circuit operate to quickly turn "off" transistor 1590. The rapid turn-off of transistor 1590 creates a rapid change of rate for the current flow which was formerly flowing through transistor 1590. The energy stored in the magnetic fields of each of the windings of the collector circuit discharge by the self-induction of a voltage. Winding 1680 and winding 1710 provides a high voltage, which is utilized for operation of the gas discharge lamp, as will be more fully described in following paragraphs. As was the case for the first half of the cycle, when the rate of change in current flow approaches a steady state value the voltage polarity in windings 1300 and 1340 reverses, turning transistor 1590 to an "on" condition, thereby providing a repetitive cycle.

Referring back to FIG. 3, the operation of the regulated power supply circuit 14 and its interrelationship with the switching circuit 16 can now be described. Control circuit 660 is an integrated circuit containing the essential elements for constructing a switching power supply having sinusoidal line-current consumption. Integrated circuit 660 has a manufacturer's Designation Number TDA4814A, available from Siemens Components, Inc., of Santa Clara, Calif. In the ordinary application of control circuit 660, the integrated circuit 660 would be coupled to the unregulated DC voltage supply to provide actuating power therefor. However, universal electronic ballast system 10 uniquely provides a feedback voltage generated responsive to oscillation of the switching circuit 16 for powering integrated circuit 660 and the peripheral amplifier circuits 1120 and 1125. This feature enables the boost voltage generated by the regulated power supply to the shut down coincident with operation of the protective circuits which terminate oscillation of the switching circuit, as will be described in following paragraphs.

Secondary winding 820 of transformer T3, having 12 turns, is coupled in series relation with diode 810 to provide a rectified voltage from the AC voltage generated in winding 820 responsive to the repetitive operation of switching circuit 16, wherein an alternating current flows through transformer T3 primary windings 1710 and 1680. Winding 820 is coupled on one end to both the power supply common 50 and pin 670 of control circuit 660, terminal 670 being the ground coupling connection for the integrated circuit. The opposing end of winding 820 is coupled to the anode of diode 810, the cathode of diode 810 being coupled in series relation with current limiting resistor 800. Diode 810 is a 1N4148 diode and resistor 800 has a value of 270 ohms. The opposing end of resistor 800 being coupled to terminal 680 of control circuit 660 and the power input line 790 for integrated circuit comparators 1120 and 1125. The half wave rectified voltage supplied from the series combination of winding 820, diode 810 and resistor 800 is filtered by a 10 μf storage capacitor 830 coupled in parallel relation with the series combination of aforementioned elements. In shunt relation with storage capacitor 830 there is provided a 0.1 μf bypass capacitor 840 for providing high frequency filtering of the voltage supplied to integrated circuit 660 and comparators 1120 and 1125. Comparators 1120 and 1125 are coupled to the return side of the half wave power source by means of the return line 795. Comparators 1120 and 1125 are both part of a single integrated circuit having a designation LM393N, available from National Semiconductor Corp. of Santa Clara, Calif.

Subsequent to being energized, integrated circuit 660 provides a pulsating drive signal to transistor 540 by means of the coupling between gate 930 and terminal 700. Transistor 540 is a power field effect transistor having the Manufacturer's Designation MTP2N50, available from Motorola, Inc. of Tempe. Az. Responsive to the voltage applied to gate 930 of transistor 540, transistor 540 turns "on", providing a conductive path between the drain 550 and source 560. The source 560 of transistor 540 is coupled in series relation with a resistor 1020, having a low resistance value approximating 0.33 Ohms, whose function will be more fully understood in following paragraphs. The low impedance path between line 520 and the power supply common 50 provides a significant current flow from the unregulated voltage power input line 450 through line 530, and through the voltage boost primary transformer winding 500 of transformer T4. As previously stated, the drive signal supplied from terminal 700 of integrated circuit 660 is a pulsating signal, having a frequency approximating 30 khz, for alternately switching transistor 540 between "on" and "off" conditions. Transformer T4 is formed on a commercially available core having a designation P42510, available from Magnetics, Inc., with winding 500 having 180 turns and winding 900 having 36 turns.

Responsive to the sudden discontinuance of current flow through transistor 540 when the transistor is switched off, a voltage is induced within primary winding 500 of transformer T4, which is substituted for the unregulated voltage previously supplied to the diode 510. The voltage generated by winding 500 is supplied to the regulated voltage output line 1640 by means of the diode 990. The anode of diode 990 is coupled to line 520 for supplying the induced voltage thereto. The cathode of diode 990 is coupled to output line 1640, thereby providing the series combination of winding 500 and diode 990 coupled in parallel relationship with the diode 510. Thus by designing winding 500 to generate a voltage greater than the unregulated voltage supplied on line 450, such reverse biases diode 510, thereby replacing the unregulated voltage previously coupled to output line 1640 by diode 510 with the voltage induced in winding 500. Diode 990 is commercially available and has a designation of 1N4937.

In order to regulate this induced voltage, a number of feedback signals must be provided to the control circuit 660. The first of these feedback signals is provided from the voltage divider formed by the series coupled resistors 470 and 870. Resistor 470, having a value of 1.0 megohms, is coupled on one end to the unregulated power supply input line 450, and on the opposing end to the input terminal 770 and one end of the 7.5 Kohm resistor 870, the opposing end of resistor 870 being coupled to the power supply return 50. Resistor 870 is shunted by a 10 nf filter capacitor 850, provided for decoupling any transient variations in the feedback signal supplied to input terminal 770. Thus, the voltage supplied by the voltage divider to input terminal 770 is proportional to the unregulated DC voltage supplied to the regulated power supply input line 450. Responsive to changes in the unregulated input voltage supplied at line 450, integrated circuit 660 modulates the pulse width of the pulsating drive signal supplied from terminal 700 for changing the relative "on" and "off" times of transistor 540, whereby the induced voltage from winding 500 is adjusted to compensate for any change in input voltage.

To more finely regulate the voltage generated, a second monitoring voltage divider is provided at the output of the regulated power supply circuit. Resistor 1210, having a value approximating 1.1 megohms, is coupled on one end to the regulated power supply output line 1640 and on the opposing end to the comparator input lead 1170 by way of connection line 1110 and one end of a 4.99 Kohm resistor 1230, the opposing end of resistor 1230 being coupled to the power supply return 50. Thus, the voltage supplied to the comparator input line 1170 from the coupling node 1240 between resistors 1210 and 1230 provides a voltage proportional to that appearing on the regulated voltage output line 1640. The opposing input lead 1160 of comparator 1120 is coupled to a reference voltage supplied by terminal 740 of control circuit 660 for use by comparator 1120 in generating an error signal at the comparator output line 1130, which provides feedback to control circuit 660. Capacitor 1140, having a value of 0.1 μf., is coupled between the reference voltage terminal 740 and the power supply return 50 for decoupling any high frequency signals therefrom. Similarly, 0.001 μf. capacitor 1100 is coupled between input terminals 1170 and 1160 of comparator 1120.

The output of comparator 1120 is coupled to the input terminal 770 of integrated circuit 660 for further affecting the pulse width modulation of the output drive signal responsive to changes in load conditions which might otherwise affect the output voltage supplied to line 1640.

Control circuit 660 maintains a sinusoidal line-current load for the AC power supply mains, thereby substantially eliminating harmonic frequency generation typically produced by switching-type power supplies. In order to control the switching of transistor 540 so as to prevent gaps in the current flowing through winding 500, integrated circuit 660 must monitor the current through winding 500, the current flowing through transistor 540 and the phase relationship between the voltage generated and the current.

The current through winding 500 of transformer T4 is monitored by virtue of the secondary winding 900 coupled to terminal 760 of integrated circuit 660 by means of the series coupled 47 Kohm resistor 890. Thus, the secondary winding 900 is coupled on one end to the power supply return 50 and on the opposing end to one end of resistor 890, whose opposing end is coupled to the input terminal 760. Coupled in parallel relationship with the series combination of winding 900 and resistor 890 is a voltage divider formed by the series combination of resistors 920 and 910, having values of 150 Kohms and 2.2 Kohms, respectively. The node therebetween being coupled to the input terminal 750, for providing a "START" signal for use internal to the integrated circuit. The current flowing through transistor 540 is monitored by means of the source resistor 1020, providing a voltage thereacross proportional to the current flow therethrough. This voltage is fed back to integrated circuit 660 by means of the coupling line 635 coupled between the source 570 of transistor 540 and the input terminal 690 of control circuit 660.

Additionally, the current flowing through the transistor 540 is further monitored by the comparator 1125. The voltage across source resistor 1020 is coupled to 3.32 Kohm resistor 630 which in turn is coupled to comparator input line 610, for comparison with a predetermined reference voltage supplied to the comparator input 620. This predetermined comparator reference voltage is generated by a voltage divider formed by the series combination of resistors 600 and 580, wherein one end of 10 Kohm resistor 600 is coupled to the reference voltage output terminal 740 and the opposing end of resistor 600 being coupled to one end of 4.99 Kohm resistor 580, the opposing end of resistor 580 being coupled to the power supply return 50. The coupling node between resistors 580 and 600 is coupled to the comparator input line 620 for providing the predetermined reference voltage thereto. A 0.001 μf. bypass capacitor 590 is coupled between the comparator input lines 610 and 620 to shunt any high frequency transient signals therefrom. The output of comparator 1125 is coupled to the input terminal 770, as was the comparator 1120 for providing gain responsive regulation of the operation of transistor 540.

Control circuit 660 monitors the ripple on the output voltage through a voltage divider formed by resistor 1070, having a value approximating 1.1 megohms, and a 4.99 Kohm resistor 1090, coupled in series relation between the DC voltage output line 1640 and the power supply common 50. The node therebetween resistors 1070 and 1090 provides a voltage proportional to the output voltage supplied on line 1640. That proportional voltage is supplied to control circuit 660 by means of the voltage divider network and frequency trap comprising resistors 1040, 1050, having values of 20 Kohms and 200 Kohms, respectively, and 0.1 μf. capacitor 1060. The resistor 1050 being coupled in parallel relation with the capacitor 1060 between the terminals 720 and 730 of integrated circuit 660. This filter trap provides and error signal representing the ripple voltage, which is undesired, on the regulated DC output supplied at line 1640. The signals input to terminals 720 and 730 provide additional triggering control of the pulse width modulated drive signal supplied from terminal 700 to the gate 930 of transistor 540.

Control circuit 660 also requires a logic input for initiating the operation of the internal circuitry, which is provided by a voltage input to the terminal 710 of control circuit 660. This voltage input is provided by the resistor diode network formed by resistors 960, 970 and diode 980. Resistor 960, having a value of 1.0 megohms, is coupled on one end to regulated output voltage line 1640 and on the opposing end to terminal 710 by means of the coupling line 940 and to one end of the 470 ohm resistor 970. The opposing end of resistor 970 is coupled in series relation with the anode of diode 980, the cathode of diode 980 being coupled to the anode of diode 990. The input terminal 710 is coupled to a 0.001 μf. bypass capacitor 950 by means of the coupling line 940, whereby high frequency transients are coupled to the power supply return 50. Diode 980 may be a 1N4937 diode.

The regulated voltage provided on the power supply output line 1640 is coupled to the switching circuit input line 1660 for generation of a pulsating regulated current by the repetitive switching "on" and "off" of transistor 1590, as has previously been described. The switching circuit 16 includes overcurrent and no-load protection circuits which operate to shut down the repetitive switching of transistor 1590 under predetermined conditions. Further, these circuits also serve to regulate the pulsating current from which the lamp actuating voltage is generated. In addition to the current feedback provided by the tapped primary winding 1680, 1710 of induction transformer T3, the current is monitored by means of the resistor 1540, coupled in series relation with the emitter 1600 of transistor 1590. Emitter 1600 is coupled in series relation with a pair of series coupled diodes 1560 and 1580, provided for breakdown voltage protection, which in turn is coupled to one end of resistor 1540, the opposing end of resistor 1540 being coupled to the return line 50. A 10 μf. bypass capacitor 1550 shunts the two diodes 1580 and 1560 for decoupling the emitter 1600 of transistor 1590.

The voltage drop across resistor 1540 is proportional to the emitter current flowing therethrough, thereby providing means for monitoring the switching circuit's operation. The node 1535 between diode 1560 and resistor 1540 is coupled to a transistor 1382 through a 200 ohm resistor 1530 coupled on one end to the node 1535 and on the opposing end to the base 1470 of transistor 1382. A 2200 pf. capacitor 1500 is coupled between the base and emitter of transistor 1382 for the decoupling thereof. Transistor 1382 is an NPN type transistor having the Designation Number 2N2222A manufactured by National Semiconductor of Santa Clara, Calif. The collector of transistor 1382 is coupled to a resistor 270 ohm 1390 and the base 1510 of transistor 1440, by the coupling line 1520. Resistor 1390 being coupled to coupling line 1520 on one end is coupled to the base drive line 1630 on the opposing end. Transistor 1440 is a PNP type transistor having the Designation Number 2N3906 manufactured by National Semiconductor of Santa Clara, Calif. The emitter 1450 of transistor 1440 is coupled to the base drive line 1630 and the collector 1460 is coupled to the base 1470 of transistor 1382. Thus, the collector-to-emitter path of transistor 1440 is coupled in shunt relationship with the series combination of the base-to-emitter junction of transistor 1590, diodes 1580 and 1560, and resistor 1530.

When the emitter current of transistor 1590 reaches a predetermined value, the voltage drop across resistor 1540 is sufficient to turn "on" the transistor 1382, thereby coupling the base 1510 of transistor 1440 to a potential substantially below that of the emitter 1450, turning transistor 1440 "on". When transistor 1440 is turned "on" such essentially pulls the base potential of transistor 1590 below the voltage on the emitter 1600, forcing transistor 1590 to an "off" condition. While such a circuit configuration could be utilized for strictly overcurrent protection, by selecting the maximum allowable current as a function of the operating parameters for electronic ballast system 10, this "shut down" circuit functions to aid in regulation of the pulsating switching current.

While the LC time constants provided in the base and collector circuits operate to control the overall oscillation frequency and "on-time" of the transistor, the turn-off time is significantly affected by the transistor's storage time and its gain. By responding to the emitter current, transistor 1590 can be turned off prematurely, with respect to the oscillation frequency established by the base drive circuit, and thereby compensate for these transistor characteristics which would tend to extend the "on" time of the transistor. In this way electronic ballast system 10 is able to compensate for variations between one transistor 1590 and another. The base 1630 of transistor 1590 is protected from negative voltage spikes by a reversed biased diode string, as is well known in the art. Diodes 1350, 1360 and 1370 are coupled in series relation for shunting any negative voltage spikes from the base of transistor 1590. The anode of diode 1370 is coupled to the power supply return line 50 and the cathode of diode 1350 is coupled to the base drive line 1630. Each of diodes 1350, 1360 and 1370 are a 1N4148 diode.

As previously stated, when transistor 1590 is conducting, current flows through the tapped primary winding formed by the windings 1710 and 1680 of induction transformer T3, storing energy in the magnetic fields thereof. The sudden change in current, when transistor 1590 is turned "off", induces a high voltage in winding 1680, which is added to the voltage induced in winding 1710 to cause a current to flow which is substantially equal to that which was flowing through the windings just prior to the transistor turning "off". The voltages generated by this inductive "kick" is of opposite polarity to that which was dropped across the inductive impedances when the transistor was in an "on" condition, and thereby changes the polarity of the voltage induced in the base drive circuit, which reinforces the "off" condition. Here again, when the current flow between line 1660 and the power supply return 50 through windings 1740, 1730, 1710 and 1680 and capacitor 1700 approaches a steady state value, the "turn-on" sequence repeats.

Figure 5:
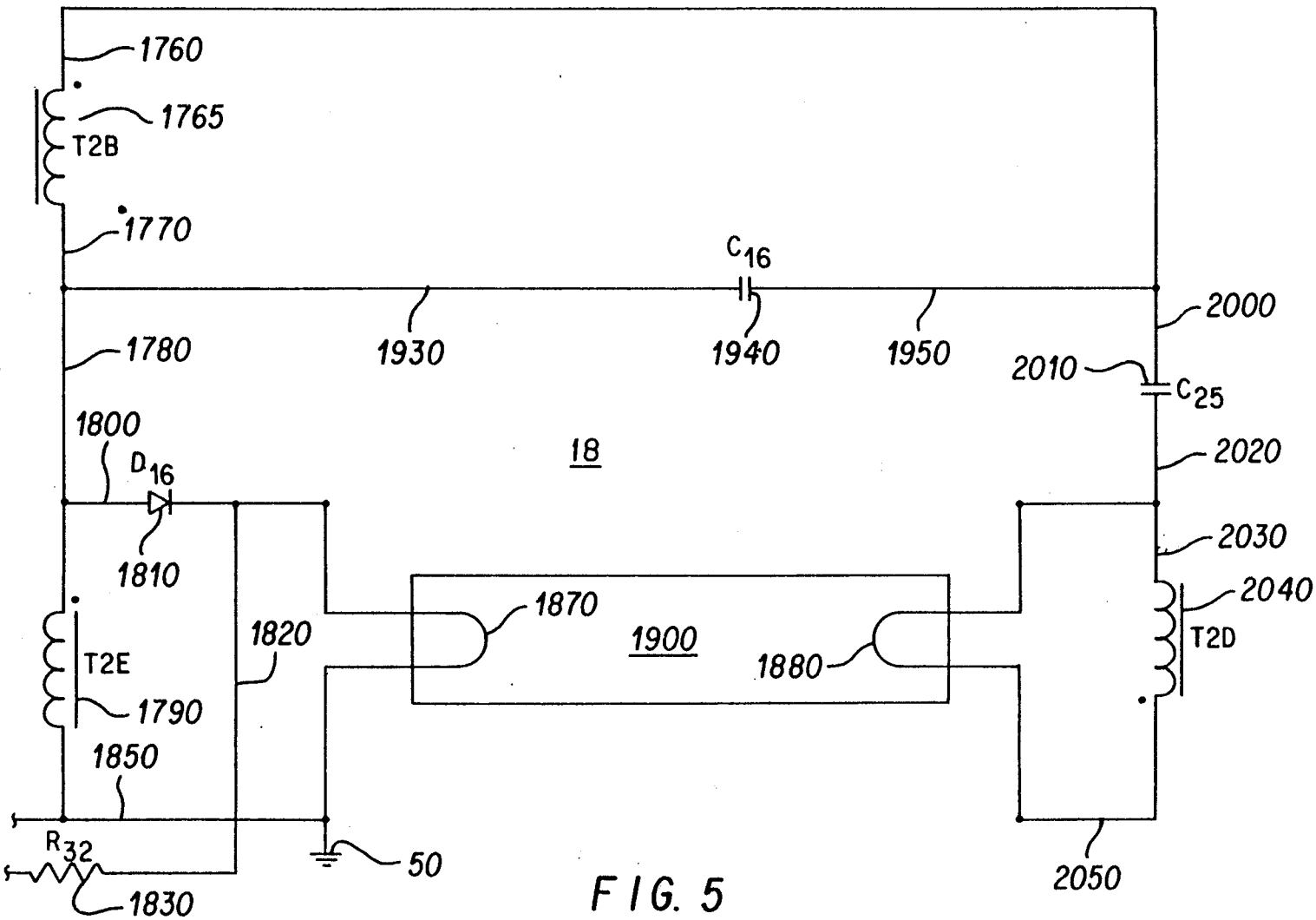

The voltages induced are coupled to the gas discharge lamp 1900 by means of the output transformer T2 through the magnetic coupling with primary winding 1730. Transformer T2 is formed on a commercially available core having a designation number P43007 available from Magnetics, Inc. of East Butler, Pa. Primary winding 1730 is formed with 90 turns, secondary winding 1765 is formed with 180 turns, secondary winding 2040 has 3 turns, and secondary winding 1790 includes 7 turns. As shown in FIG. 5, the actuation voltage supplied to gas discharge lamp 1900 is induced in the tuned secondary winding 1765 of output transformer T2. Secondary winding 1765 is tuned by the 15 nf capacitor 1940 coupled in parallel relation with the winding 1765 for generating a sinusoidal voltage. This sinusoidal voltage is coupled to the gas discharge lamp through a series coupled 0.1 μf. capacitor 2010. Additionally, output transformer T2 includes a pair of filament voltage windings 1790 and 2040, each coupled to a respective filament 1870 and 1880. Filament voltage from winding 1790 is coupled to filament 1870 through a diode 1810, having a designation 1N4934, for isolating the filament sense current from the filament winding 1790.

Detection of a no-load condition, when the gas discharge lamp 1900 is removed from the circuit, is achieved by coupling a small DC current through filament 1870. A voltage divider is formed by the series combination of resistors 1270, 1830, and the filament 1870. Resistor 1270 has a value of 470 Kohms and is coupled on one end to the switching circuit input line 1660 and on the opposing end to coupling line 1280. Resistor 1830 has a value of 10 Kohms and is coupled on one end to the coupling line 1280 and on the opposing end to one end of filament 1870, the opposing end of filament 1870 being coupled to the power supply return line 50. Thus, when gas discharge lamp 1900 is electrically connected to electronic ballast system 10, a current flows through the resistors 1270 and 1830 and through the filament 1870. A zener diode 1490, having a designation 1N5256B, is coupled to the node 1840 of coupling line 1280 for sensing the voltage drop across resistor 1830 and filament 1870. The voltage drop across resistor 1830 and filament 1870 is predetermined to be below the zener voltage of diode 1490. The anode of diode 1490 is coupled to the base of a transistor 1380 which is coupled in parallel relationship with the transistor 1382, the collectors of both transistors 1380 and 1382 being joined to the coupling line 1520 and both emitters being coupled to a coupling line 1480, which is in turn coupled to the power supply return line 50. It can therefore be seen that either transistor 1380 or 1382, when turned "on", will bias the transistor 1440 to an "on" condition, shutting down the conduction of transistor 1590. Transistor 1380 is the same type as transistor 1382, and has the same manufacturer's designation.

When gas discharge lamp 1900 is electrically removed from the electronic ballast system 10, the current flowing through resistors 1270 and 1830 ceases, thereby raising the potential of the node 1840 to substantially the input voltage on line 1660. This voltage biases the zener diode 1490, into conduction and thereby turns "on" transistor 1380. As previously stated, when transistor 1380 is turned "on", such turns on transistor 1440, which in turn shuts down the switching transistor 1590. This no-load protection circuit prevents the high voltage generation which normally actuates the gas discharge lamp, when the lamp is removed from the circuit, thereby making the replacement of fluorescent type gas discharge tubes considerably safer than prior art systems. Additionally, this shut-down of the high voltage generation also ceases the induction of voltage in the secondary winding 820 of induction transformer T3. This in turn shuts down the boost voltage generated by the regulated power supply, supplying only the much lower rectified voltage supplied to the input of the regulated power supply.

It can therefore be seen that the concatenation of elements which comprise the universal electronic ballast system 10 provides a highly efficient and extremely well regulated means for actuating a gas discharge lamp. The regulated power supply portion of the circuit has been designed to generate a boost voltage approximating 430 volts, and allows operation with AC input voltages in the range of 85–275 volts. Additionally, since the boost voltage is generated by a switching power supply having its own frequency control, electronic ballast system operates equally well on 50 and 60 cycle power systems. Lastly, improved switching circuit operation is achieved by the means by which the transistor 1590 is quickly turned "off" at a predetermined current value for maintaining consistent circuit operation independent of the characteristics of a particular transistor 1590. This regulation in combination with the resonant collector circuit allows for the actuation of a wide variety of gas discharge lamps having varying electrical characteristics and wattages which range from approximately between 20–50 watts.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined by the appended Claims.

What is claimed is:

1. A universal electronic ballast system coupled to a power source for actuating at least one gas discharge lamp having any one of a plurality of predetermined wattage ratings, said gas discharge lamp having a pair of heater filaments, comprising:

(a) filter means coupled to said power source for substantially suppressing spurious signals from passing into or from said power source;

(b) regulated power supply means coupled to said filter means for (1) maintaining a substantially constant sinusoidal load current from said power source substantially in phase with a sinusoidal voltage from said power source, and (2) providing a regulated DC voltage output, thereby substantially preventing generation of harmonic frequency signals;

(c) switching means coupled to said regulated output of said regulated power supply means for generating a regulated pulsating current at a predetermined frequency; and, (d) induction means coupled to said switching means for actuating said gas discharge lamp, said induction means including an output transformer coupled to said gas discharge lamp, said induction means being coupled in feedback relationship to said switching means for terminating said pulsating current responsive to said gas discharge lamp being electrically uncoupled from said output transformer.

2. The universal electronic ballast system as recited in claim 1 where said switching means includes first transistor means having respective base, collector and emitter elements, said collector being coupled to a primary winding of said output transformer for inducing a voltage therein responsive to said pulsating current.

3. The universal electronic ballast system as recited in claim 2 where said switching means includes regulation means coupled to said first transistor means for regulating said pulsating current responsive to changes in a load current represented by a change in an apparent impedance value of said output transformer primary winding.

4. The universal electronic ballast system as recited in claim 3 where said regulation means includes base drive means coupled to said base of said first transistor means for generating a switching signal responsive to said pulsating current.

5. The universal electronic ballast system as recited in claim 4 where said switching means includes protection means coupled to said first transistor means for (1) regulating a gain value of said switching means responsive to said pulsating current exceeding a predetermined value, and (2) terminating said switching signal responsive to a feedback signal from said induction means indicating electrical uncoupling of said gas discharge lamp.

6. The universal electronic ballast system as recited in claim 5 where said protection means includes second transistor means having respective base, collector and emitter elements for shunting said switching signal from said base element of said first transistor means, said second transistor means having a collector-to-emitter path coupled in parallel relation to a base-to-emitter junction of said first transistor means.

7. The universal electronic ballast system as recited in claim 6 where said protection means includes means for detecting electrical uncoupling of said gas discharge lamp coupled to said second transistor means and said induction means.

8. The universal electronic ballast system as recited in claim 7 where said detecting means includes third transistor means coupled to said second transistor means for changing a bias condition of said base element of said second transistor means, responsive to said feedback signal.

9. The universal electronic ballast system as recited in claim 7 where said protection means includes current sensing means for changing a bias condition of said base element of said second transistor means responsive to an emitter current of said first transistor means exceeding a predetermined value.

10. The universal electronic ballast system as recited in claim 8 where said induction means includes voltage divider means coupled to one of said pair of gas discharge lamp filaments for providing said feedback signal responsive to a predetermined current flow through said filament falling below a predetermined value.

11. The universal electronic ballast system as recited in claim 4 where said base drive means includes a load current sensing transformer having a primary winding coupled in series relation with said primary winding of said output transformer, said load current sensing transformer having a secondary winding coupled in series relation with said base element of said first transistor means for regulating the magnitude of said switching signal responsive to said pulsating current.

12. The universal electronic ballast system as recited in claim 11 where said base drive means further includes a collector current sensing transformer having a tapped primary winding coupled in series relation with said primary winding of said output transformer, said tap of said tapped primary winding being coupled to said collector element of said first transistor means, said collector current sensing transformer having a first secondary winding coupled in series relation with said base element of said first transistor means for coupling a signal proportional to said collector current to said base of said first transistor means.

13. The universal electronic ballast system as recited in claim 12 where said collector current sensing transformer further includes a second secondary winding coupled to said regulated power supply means, whereby a voltage is generated for powering at least one of a plurality of active elements of said regulated power supply means responsive to generation of said pulsating current by said switching means.

14. The universal electronic ballast system as recited in claim 1 where said regulated power supply means includes control circuit means coupled to said filter means for driving a voltage boosting circuit responsive to an input signal representing a magnitude of a voltage supplied from said power source.

15. The universal electronic ballast system as recited in claim 14 where said regulated power supply means further includes first amplifier means having a input terminal coupled to said DC voltage output for generating a first feedback signal responsive to a magnitude of said DC voltage output, said first amplifier means having an output terminal coupled to said control circuit means for coupling said first feedback signal thereto.

16. The universal electronic ballast system as recited in claim 15 where said regulated power supply means further includes second amplifier means having an input coupled to said voltage boosting circuit for generating a second feedback signal responsive to an operating current of said voltage boosting circuit, said second amplifier means having an output coupled to said control circuit means for coupling said second feedback signal thereto.

17. The universal electronic ballast system as recited in claim 16 where said voltage boosting circuit includes driver transistor means coupled to said control circuit means for switching a current responsive to a modulated switching signal from said control circuit means, said modulated switching signal being pulse width modulated responsive to (1) said magnitude of said voltage supplied from said power source, (2) said first feedback signal, and (3) said second feedback signal.

18. A universal electronic ballast system coupled to a power source for actuating at least one gas discharge lamp having any one of a plurality of predetermined wattage ratings, said gas discharge lamp having a pair of heater filaments, comprising:

(a) filter means coupled to said power source for substantially suppressing spurious signals from passing into or from said power source;

(b) regulated power supply means coupled to said filter means for (1) maintaining a substantially constant sinusoidal load current from said power source substantially in phase with a sinusoidal voltage from said power source, and (2) providing a regulated D.C. voltage output, thereby substantially preventing generation of harmonic frequency signals;

(c) means for generating a regulated pulsating current coupled to said regulated output of said regulated power supply means, said pulsating current generating means includes (1) switching means having respective control, input, and output terminals wherein said output terminal is coupled to a return line of said regulated power supply means for generating said pulsating current, and (2) regulation means coupled to said switching means for regulating said pulsating current responsive to (1) a gain value of said switching means, and (2) a load current defined by said gas discharge lamp having a particular one of said plurality of predetermined wattage ratings; and (d) induction means coupled to said switching means for actuating said gas discharge lamp, said induction means including an output transformer having at least one secondary winding coupled to said gas discharge lamp, said induction means being coupled in feedback relationship to said switching means for terminating said pulsating current responsive to said gas discharge lamp being electrically uncoupled from said output transformer.

19. The universal electronic ballast system as recited in claim 18 where said regulation means includes drive means coupled to said control terminal of said switching means for generating a switching signal responsive to said pulsating current, said drive means including:

a. a first current sensing transformer having a primary winding coupled to said input terminal of said switching means and a secondary winding coupled to said control terminal for generating a first feedback signal; and, b. a second current sensing transformer having a primary winding coupled in series relation with a primary winding of said output transformer for generating a second feedback signal, said second current sensing transformer having a secondary winding coupled in series relation with said secondary winding of said first current sensing transformer, whereby said switching signal is responsive to both said first and second feedback signals.

20. The universal electronic ballast system as recited in claim 19 where said pulsating current generating means includes protection means coupled between said control and output terminals of said switching means for shunting said switching signal from said control terminal responsive to a feedback signal from said induction means indicating electrical uncoupling of said gas discharge lamp.

* * * * *